US010151455B2

(12) United States Patent
Hou et al.

(10) Patent No.: US 10,151,455 B2
(45) Date of Patent: Dec. 11, 2018

(54) DOWNLIGHT APPARATUS

(71) Applicant: XIAMEN ECO LIGHTING CO. LTD., Xiamen (CN)

(72) Inventors: Shouqiang Hou, Xiamen (CN); Xiaoliang Wen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/907,198

(22) Filed: Feb. 27, 2018

(65) Prior Publication Data

US 2018/0259165 A1 Sep. 13, 2018

(30) Foreign Application Priority Data

Mar. 10, 2017 (CN) ..... 2017 1 0140347

(51) Int. Cl.

| | |
|---|---|
| ***F21V 17/00*** | (2006.01) |
| ***F21V 17/10*** | (2006.01) |
| ***F21S 8/02*** | (2006.01) |
| ***F21V 15/01*** | (2006.01) |
| ***F21V 17/16*** | (2006.01) |
| ***F21V 21/04*** | (2006.01) |
| *F21Y 115/10* | (2016.01) |

(52) U.S. Cl.

CPC ..... *F21V 17/108* (2013.01); *F21S 8/026* (2013.01); *F21V 15/01* (2013.01); *F21V 17/162* (2013.01); *F21V 21/04* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2013/0100658 | A1* | 4/2013 | Pickard | F21S 8/02 362/230 |
| 2013/0128608 | A1* | 5/2013 | Liao | F21V 21/046 362/606 |
| 2013/0176728 | A1* | 7/2013 | Bizzotto | F21V 21/08 362/244 |
| 2015/0117002 | A1* | 4/2015 | McGough | A47G 33/08 362/236 |

* cited by examiner

*Primary Examiner* — Vip Patel

(74) *Attorney, Agent, or Firm* — Chun-Ming Shih

(57) ABSTRACT

A downlight apparatus has a major housing, multiple hook slots, and multiple hooks. The major housing has a surface ring and a main cup. The main cup contains a LED plate and a driver circuit. The LED plate emits light through an opening of the surface ring. The multiple hook slots are located surrounding the main cup. The multiple hooks have bottom hooks inserted and locked in corresponding hook slots respectively and have top hooks to fix the major housing on a ceiling.

20 Claims, 7 Drawing Sheets

DOWNLIGHT APPARATUS

FIELD OF INVENTION

The present invention is related to a light apparatus and more particularly related to a LED downlight apparatus.

BACKGROUND

There are a lot of downlight apparatuses around the world. Meanwhile, there are various types and sizes of downlight apparatuses developed. The volume of this product line is very large and affecting human life a lot. Any enhancement thereto, therefore, brings great benefit to this society.

Installation of downlight apparatuses is also important. Usually, downlight apparatuses are installed in cavities of ceilings. Certain connection structures are used as an intermediate tool for fixing downlight apparatuses to ceilings. The fixing needs to be robust for safety. In addition, people may need to replace old downlight apparatuses with new ones, and therefore, it is also important to be able to detach the downlight apparatuses conveniently.

Manufacturing cost is also an important factor on designing such element. Therefore, the present invention, as explained below, finds several enhancement to re-design related structures.

SUMMARY OF THE INVENTION

According to an embodiment of the present invention, a downlight apparatus has a major housing, multiple hook slots, and multiple hooks. The major housing has a surface ring and a main cup. The main cup contains a LED plate and a driver circuit. The LED plate emits light through an opening of the surface ring. The multiple hook slots are located surrounding the main cup. The multiple hooks have bottom hooks inserted and locked in corresponding hook slots respectively and have top hooks to fix the major housing on a ceiling.

The LED plate may be made of a substrate mounted with LED modules with Surface Mounted Device (SMD), Chip on Board (COB), flip chip, or other packaging methods. The light may emit directly downwardly through an opening defined by the surface ring. Alternatively, the light may be emitted into a light guide and redirected to pass the opening of the surface ring.

The major housing may be made of plastic material, e.g. injection molding. The main cup and the surface ring may be made as two separate components and combined with a clamp structure, screws or any other fixture structure. Alternatively, the main cup and the surface ring may be made of one piece component, e.g. directly from a molding device. The major housing may be installed to a standard box or a reception cavity of a ceiling.

In some embodiments, when the downlight apparatus is installed in the ceiling, an external ring, or other geometric shape of the surface ring is exposed and shows an opening where light is emitted from to outside environment facing to the opening.

In some embodiments, the hook is a piece of metal component. The top hook and the bottom hook are formed by bending the piece of metal component. For example, the hook is made of an elongated metal sheet. The top hook and the bottom hook are two ends of the elongated metal sheet.

In some embodiments, the top hook and the bottom hook are bent with opposite directions. For example, when the hook is an elongated metal sheet, the top end of the elongated metal sheet is bent with a right direction, and the bottom end of the elongated metal sheet is bent with a left direction. The right direction is opposite to the left direction, making the top hook is bent outwardly while the bottom hook is bent inwardly with respect to the main cup.

Specifically, the bent angle between the bottom hook and a major part of the hook is less than 50 degrees. In some cases, to decrease the hook slot side, the bent angle may be even less than 30 degrees.

Alternatively, the top hook and the bottom hook may be bent facing to each other. If previous bent manner forms a Z shape hook, this example form a U shape hook.

In some embodiments, the bottom hook is inserted into the hook slot to be locked. When the bottom hook is during insertion, the bottom hook has an elastic shape change to enter the hook slot. When the bottom hook is inserted, the bottom hook is locked by a stop structure of the hook slot.

Specifically, as an example, the hook slot allows the bottom hook to enter by changing the bent angle of the bottom hook. When the hook is made of elastic metal, the bent angle of the bottom hook may be changed, causing an elastic shape change, when the bottom hook is pressed into the hook slot that has a narrower entrance than the width of the bottom hook without the elastic shape change. In other words, the bottom hook may not enter the hook slot if the bottom hook does not have the elastic shape change, e.g. bent angle change.

On the other hand, when the bottom hook has such elastic shape change, e.g. a bent angle, with a pressing force to enter the hook slot, the bottom hook is now having a smaller width, making the bottom hook entering the entrance of the hook slot.

The stop structure of the hook slot ensures the bottom hook remained in the hook slot when the bottom hook is inserted into the hook slot.

In some cases, the stop structure may include a stop block. A top edge of the bottom hook engages with the stop block to be locked in the hook slot. For example, the stop block is formed at the entrance portion of the hook slot, so that the entrance of the hook slot is narrower than the original width, before having the elastic shape change. As mentioned above, the bottom hook is then bent or in other form change to pass the narrow entrance and to enter the hook slot.

The elastic force of the hook recovers the bottom hook back to its original manner, e.g. original bent angle. When this occurs, the top edge of the bottom hook engages with the stop block so as to keep the bottom hook in the hook slot.

In some other embodiments, the stop structure may be a slot hole for receiving part of the bottom hook when the bottom hook is inserted in the hook slot. In such case, when the bottom hook is inserting into the hook slot, the bottom hook is at an elastic shape change, e.g. a bent angle by elastic force, before the bottom hook meets the slot hole for the bottom hook to release all or part of the elastic force.

In other words, in such case, part of the bottom hook enters the slot hole and together with certain structure, like side walls, of the hook slot, the bottom hook is kept and locked in the hook slot.

In some other embodiments, the narrow entrance of the hook slot as mentioned above may be formed with a sop wall that has certain elastic characteristic. In such case, when the bottom hook is pushed to enter the narrow entrance defined by the elastic stop wall, the stop wall may change its change to allow the bottom hook to pass.

Similarly as mentioned above, after the bottom hook passes the narrow entrance, its elastic force recovers the bottom hook in a larger space. Combined with a block or a hole, the bottom hook is kept and locked in the hook slot.

In some embodiments, to better ensure the safety of the downlight apparatus, the hook is expected to be fixed robustly to the major housing of the downlight apparatus. Specifically, when the hook is fixed to the hook slot of the major housing, unless with tools like destructive force or knife, the hook is locked and non-detachable from the hook slot.

In some embodiments, the hook slots are disposed at external lateral side of the main cup. This may reduce the length of the hook, saving cost.

In some other embodiments, the hook slots are disposed at the surface ring. This design may keep better fixing connection between the main cup and the surface ring.

In some embodiments, although there is a structure lock between the hook and the hook slot, fixing glue may be applied in the hook slots to enhance the fixture structure.

In some embodiments, the main cup is detachable from the surface ring, and the main cup and the surface ring are combined with a clamp structure. In other words, the main cup and the surface ring are two separable components combined with certain fixing structure.

In some embodiments, further, there is a waterproof cover between the surface ring and the main cup. Since the main cup may be mounted with LED plate, which is better kept away from water, the waterproof cover may prevents water to enter the LED plate via the connection between the main cup and the surface ring.

The waterproof cover may be transparent or translucent so that light may pass through the waterproof cover. The water proof cover may also serve as a diffusion layer to soften the light emitted from the LED components inside the main cup.

In some other embodiment, the main cup and the surface ring are formed together with one piece plastic material.

In some embodiments, the top hook may have curved grooves to better fix to a box or a cavity of a ceiling.

In some other embodiments, the top hook is connected to a spring bar. The spring bar is used for installing the downlight apparatus on a ceiling. For example, the middle portion of the spring bar is fixed to the top hook, which may not need to be a bent shape, and has two extended ends that may change angle with respect to the middle portion.

In some embodiments, there are two hooks at opposite positions at two sides of the main cup. In some other embodiments, there are three hooks evenly distributed around the main cup. There may be other numbers of hooks for different design purposes.

DETAILED DESCRIPTION

Figure 1:
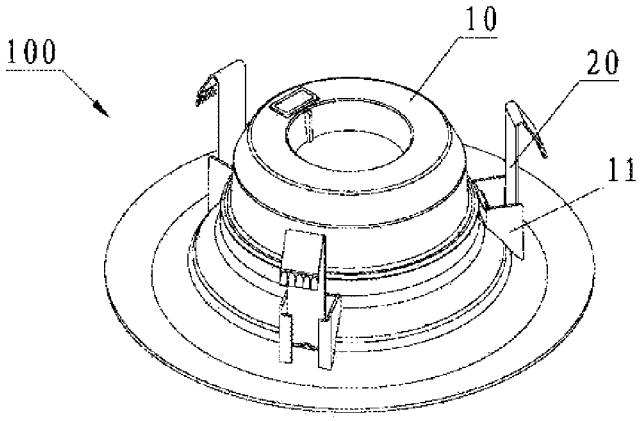
FIG. 1 is a three-dimensional diagram of a downlight apparatus embodiment.

According to an embodiment of the present invention, a downlight apparatus has a major housing, multiple hook slots, and multiple hooks. The major housing has a surface ring and a main cup. The main cup contains a LED plate and a driver circuit. The LED plate emits light through an opening of the surface ring. The multiple hook slots are located surrounding the main cup. The multiple hooks have bottom hooks inserted and locked in corresponding hook slots respectively and have top hooks to fix the major housing on a ceiling.

The LED plate may be made of a substrate mounted with LED modules with Surface Mounted Device (SMD), Chip on Board (COB), flip chip, or other packaging methods. The light may emit directly downwardly through an opening defined by the surface ring. Alternatively, the light may be emitted into a light guide and redirected to pass the opening of the surface ring.

The major housing may be made of plastic material, e.g. injection molding. The main cup and the surface ring may be made as two separate components and combined with a clamp structure, screws or any other fixture structure. Alternatively, the main cup and the surface ring may be made of one piece component, e.g. directly from a molding device. The major housing may be installed to a standard box or a reception cavity of a ceiling.

In some embodiments, when the downlight apparatus is installed in the ceiling, an external ring, or other geometric shape of the surface ring is exposed and shows an opening where light is emitted from to outside environment facing to the opening.

In some embodiments, the hook is a piece of metal component. The top hook and the bottom hook are formed by bending the piece of metal component. For example, the hook is made of an elongated metal sheet. The top hook and the bottom hook are two ends of the elongated metal sheet.

In some embodiments, the top hook and the bottom hook are bent with opposite directions. For example, when the hook is an elongated metal sheet, the top end of the elongated metal sheet is bent with a right direction, and the bottom end of the elongated metal sheet is bent with a left direction. The right direction is opposite to the left direction, making the top hook is bent outwardly while the bottom hook is bent inwardly with respect to the main cup.

Specifically, the bent angle between the bottom hook and a major part of the hook is less than 50 degrees. In some cases, to decrease the hook slot side, the bent angle may be even less than 30 degrees.

Alternatively, the top hook and the bottom hook may be bent facing to each other. If previous bent manner forms a Z shape hook, this example form a U shape hook.

In some embodiments, the bottom hook is inserted into the hook slot to be locked. When the bottom hook is during insertion, the bottom hook has an elastic shape change to enter the hook slot. When the bottom hook is inserted, the bottom hook is locked by a stop structure of the hook slot.

Specifically, as an example, the hook slot allows the bottom hook to enter by changing the bent angle of the bottom hook. When the hook is made of elastic metal, the bent angle of the bottom hook may be changed, causing an elastic shape change, when the bottom hook is pressed into the hook slot that has a narrower entrance than the width of the bottom hook without the elastic shape change. In other words, the bottom hook may not enter the hook slot if the bottom hook does not have the elastic shape change, e.g. bent angle change.

On the other hand, when the bottom hook has such elastic shape change, e.g. a bent angle, with a pressing force to enter the hook slot, the bottom hook is now having a smaller width, making the bottom hook entering the entrance of the hook slot.

The stop structure of the hook slot ensures the bottom hook remained in the hook slot when the bottom hook is inserted into the hook slot.

In some cases, the stop structure may include a stop block. A top edge of the bottom hook engages with the stop block to be locked in the hook slot. For example, the stop block is formed at the entrance portion of the hook slot, so that the entrance of the hook slot is narrower than the original width, before having the elastic shape change. As mentioned above, the bottom hook is then bent or in other form change to pass the narrow entrance and to enter the hook slot.

The elastic force of the hook recovers the bottom hook back to its original manner, e.g. original bent angle. When this occurs, the top edge of the bottom hook engages with the stop block so as to keep the bottom hook in the hook slot.

In some other embodiments, the stop structure may be a slot hole for receiving part of the bottom hook when the bottom hook is inserted in the hook slot. In such case, when the bottom hook is inserting into the hook slot, the bottom hook is at an elastic shape change, e.g. a bent angle by elastic force, before the bottom hook meets the slot hole for the bottom hook to release all or part of the elastic force.

In other words, in such case, part of the bottom hook enters the slot hole and together with certain structure, like side walls, of the hook slot, the bottom hook is kept and locked in the hook slot.

In some other embodiments, the narrow entrance of the hook slot as mentioned above may be formed with a sop wall that has certain elastic characteristic. In such case, when the bottom hook is pushed to enter the narrow entrance defined by the elastic stop wall, the stop wall may change its change to allow the bottom hook to pass.

Similarly as mentioned above, after the bottom hook passes the narrow entrance, its elastic force recovers the bottom hook in a larger space. Combined with a block or a hole, the bottom hook is kept and locked in the hook slot.

In some embodiments, to better ensure the safety of the downlight apparatus, the hook is expected to be fixed robustly to the major housing of the downlight apparatus. Specifically, when the hook is fixed to the hook slot of the major housing, unless with tools like destructive force or knife, the hook is locked and non-detachable from the hook slot.

In some embodiments, the hook slots are disposed at external lateral side of the main cup. This may reduce the length of the hook, saving cost.

In some other embodiments, the hook slots are disposed at the surface ring. This design may keep better fixing connection between the main cup and the surface ring.

In some embodiments, although there is a structure lock between the hook and the hook slot, fixing glue may be applied in the hook slots to enhance the fixture structure.

In some embodiments, the main cup is detachable from the surface ring, and the main cup and the surface ring are combined with a clamp structure. In other words, the main cup and the surface ring are two separable components combined with certain fixing structure.

In some embodiments, further, there is a waterproof cover between the surface ring and the main cup. Since the main cup may be mounted with LED plate, which is better kept away from water, the waterproof cover may prevents water to enter the LED plate via the connection between the main cup and the surface ring.

The waterproof cover may be transparent or translucent so that light may pass through the waterproof cover. The water proof cover may also serve as a diffusion layer to soften the light emitted from the LED components inside the main cup.

In some other embodiment, the main cup and the surface ring are formed together with one piece plastic material.

In some embodiments, the top hook may have curved grooves to better fix to a box or a cavity of a ceiling.

In some other embodiments, the top hook is connected to a spring bar. The spring bar is used for installing the downlight apparatus on a ceiling. For example, the middle portion of the spring bar is fixed to the top hook, which may not need to be a bent shape, and has two extended ends that may change angle with respect to the middle portion.

In some embodiments, there are two hooks at opposite positions at two sides of the main cup. In some other embodiments, there are three hooks evenly distributed around the main cup. There may be other numbers of hooks for different design purposes.

Figure 2A:
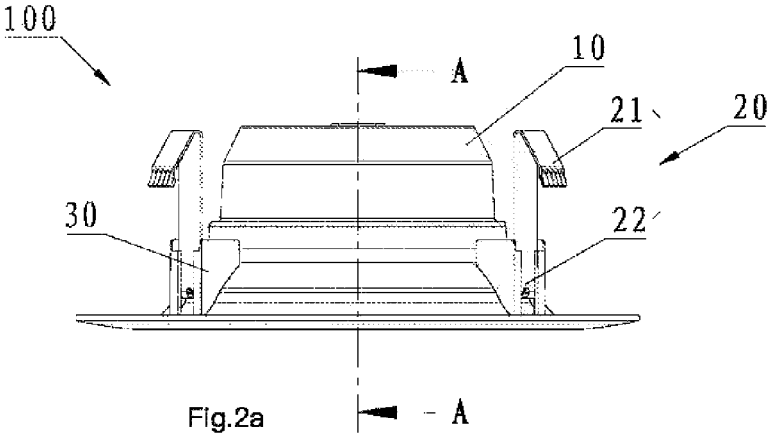
FIG. 2*a* is a perspective view of the downlight apparatus according to the present invention.
Figure 2B:
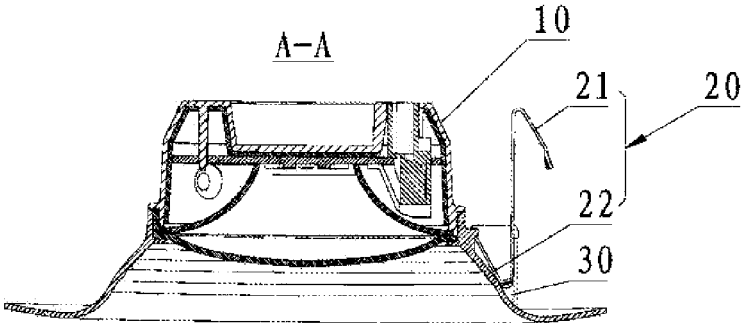
FIG. 2*b* is a cross-sectional view along line A-A of FIG. 2*a*.

Please refer to FIG. 1, FIG. 2*a*, and FIG. 2*b*, which illustrate a downlight apparatus embodiment.

The downlight apparatus 100 includes a housing 10 and multiple hooks 20. The downlight apparatus 100 is fixed to the external mounting structure by the hooks 20. The hook 20 includes a hook part 21 as the top hook and a connection part 22 as the bottom hook. The hook 20 is attached to the housing 10 by the connection part 22.

The benefits at least include following items. The connecting structure between the hooks and the housing is designed as a hooking structure. Compared with current hooks and housing, which are fixed together by screws, the hook of the present invention is simplified. The production cost of the downlight apparatus is reduced. Because of the installation method of hooking structure, the hook is attached to the housing under somewhat pressure, the production processes are simplified. The automatic assembly of the downlight apparatus is achieved, and the production efficiency is significantly improved.

Furthermore, please refer to FIG. 2*a* and FIG. 2*b*. The hook part 21 is set on one end of the hook 20, and the connection part 22 is set on the other end of the hook 20.

As mentioned above, the benefit of the present invention is that two main functional part of the hook are set on opposite end of the hook respectively, which makes the structure of the hook simplified. The hook is easy to produce, and the production cost of the hook is reduced.

Figure 3:
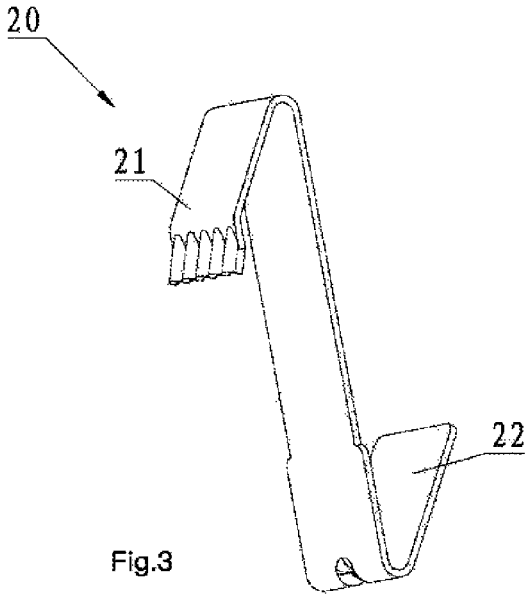
FIG. 3 is a three-dimensional diagram of a hook of a downlight apparatus embodiment.

Furthermore, please refer to FIG. 3. The hook 20 may be set as a leaf spring. The connection part 22 is formed by bending the end of the hook 20.

As mentioned above, the benefit of the present invention is that the connection part is formed by bending the end of the hook. The hook is easy to produce.

Furthermore, please refer to FIG. 1, FIG. 2*a* and FIG. 2*b*. A hook slot 30 may be set on the housing 10, and the connection part 22 is elastically fixed to the hook slot 30.

As mentioned above, the benefit of the present invention is that the connection part is elastically fixed to the hook slot. The installation processes are easier and more convenient.

Furthermore, there are at least two hook slots. The hook slots are uniformly distributed around the axis of the downlight apparatus on the housing.

As mentioned above, the benefit of the present invention is that uniform distribution of the hook slots assists in the even distribution of stress on the hooks when the hooks are attached to the mounting structure.

Figure 4:
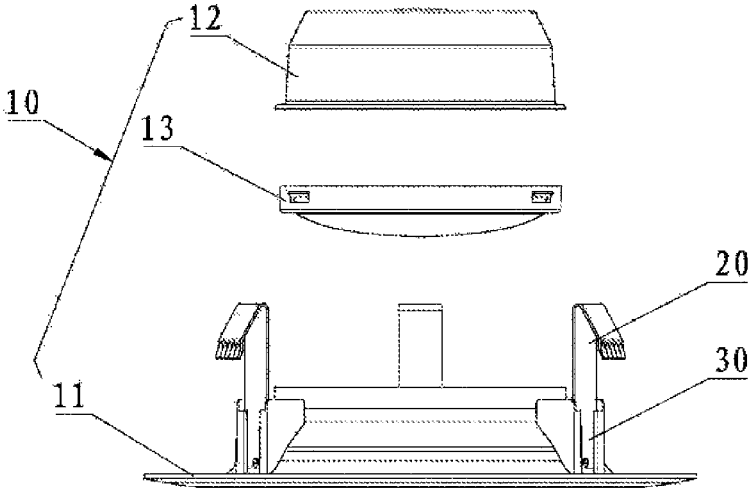
FIG. 4 is an exploded perspective view of the first structure of the downlight apparatus according to the present invention.

Furthermore, please refer to FIG. 4. The housing 10 includes a surface ring 11 and a main cup 12. The hook slot 30 is set on the surface ring 11. A LED light source is mounted inside the main cup 12.

As mentioned above, the benefit of the present invention is that the housing is modularized with common specification. The housing is made up of two modules, the surface ring and the main cup. The assembly processes of two modules are independent, each module is produce independently, the limitation from the installation processes disappears. The production efficiency doubles, and the production cost is reduced, which is helpful to mass production.

Furthermore, the hook slot is enclosed by at least two side walls, which stick out from the surface of the surface ring.

Figure 5A:
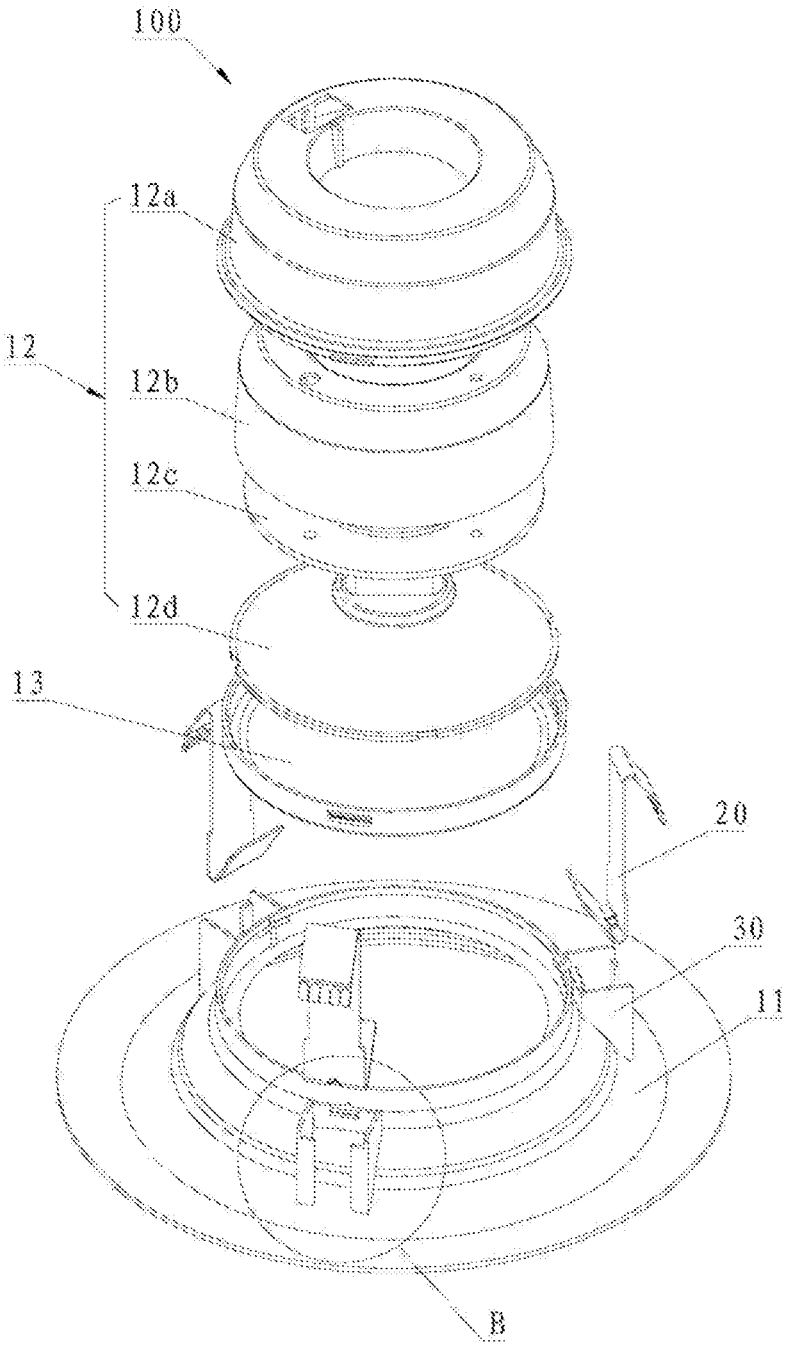
FIG. 5*a* is an exploded perspective view of the second structure of the downlight apparatus according to the present invention.
Figure 5B:
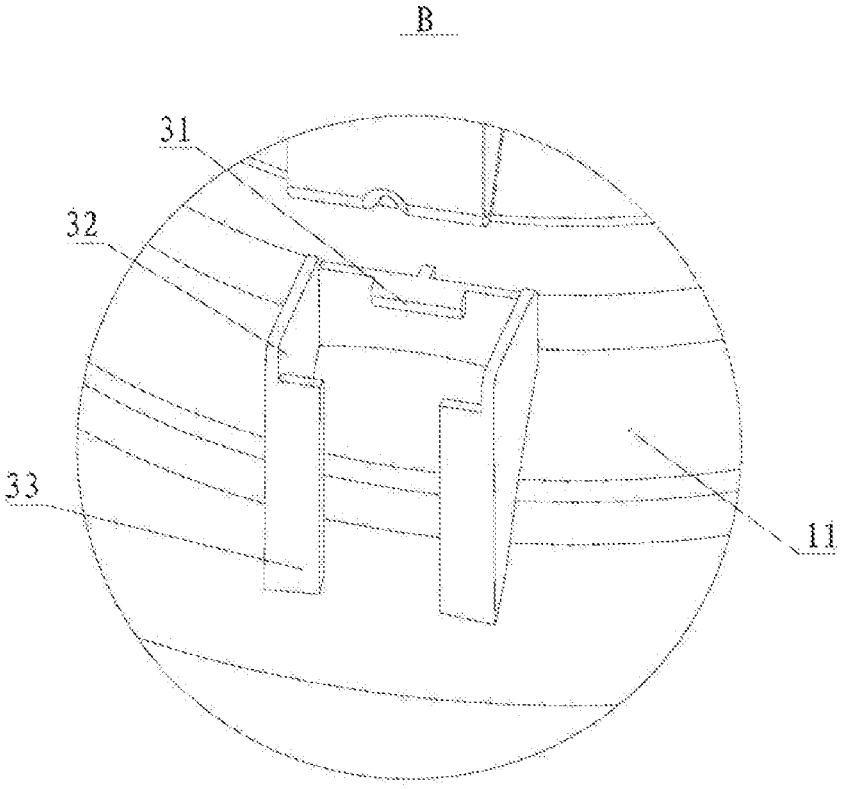
FIG. 5*b* is an enlarged fragmental perspective view of B of FIG. 5*a*.

Furthermore, please refer to FIG. 5*b*. A stop block 31 is set inside the hook slot 30. The connection part 22 is hooked inside the hook slot 30 by the stop block 31.

As mentioned above, the benefit of the present invention is: when the hook is inserted into the hook slot, the stop block exerts force on the connection part of the hook to cause an elastic deformation of the connection part; when the connection part is completely inserted into the hook slot, the force has been removed, then the connection recovers its original configuration; at this time, the stop block is on the direction in which the connection part is pulled off from the hook slot, the hook is unable to be pulled off from the hook slot directly. This kind of design allows the hook to be fixed to the hook slot.

Furthermore, please refer to FIG. 5*b*. The hook slot 30 is enclosed by two parallel side walls 32 and a stop wall 33 set on the side wall. One end of the side wall 32 is fastened on the surface of the surface ring 11, and the other end of the side wall 32 is provided with the stop wall 33.

As mentioned above, the benefit of the present invention is that the stop wall prevents the hook from coming loose from the hook slot when the hook slot is designed as an incompletely closed groove shape, which ensure the hook be fastened to the hook slot.

Figure 6:
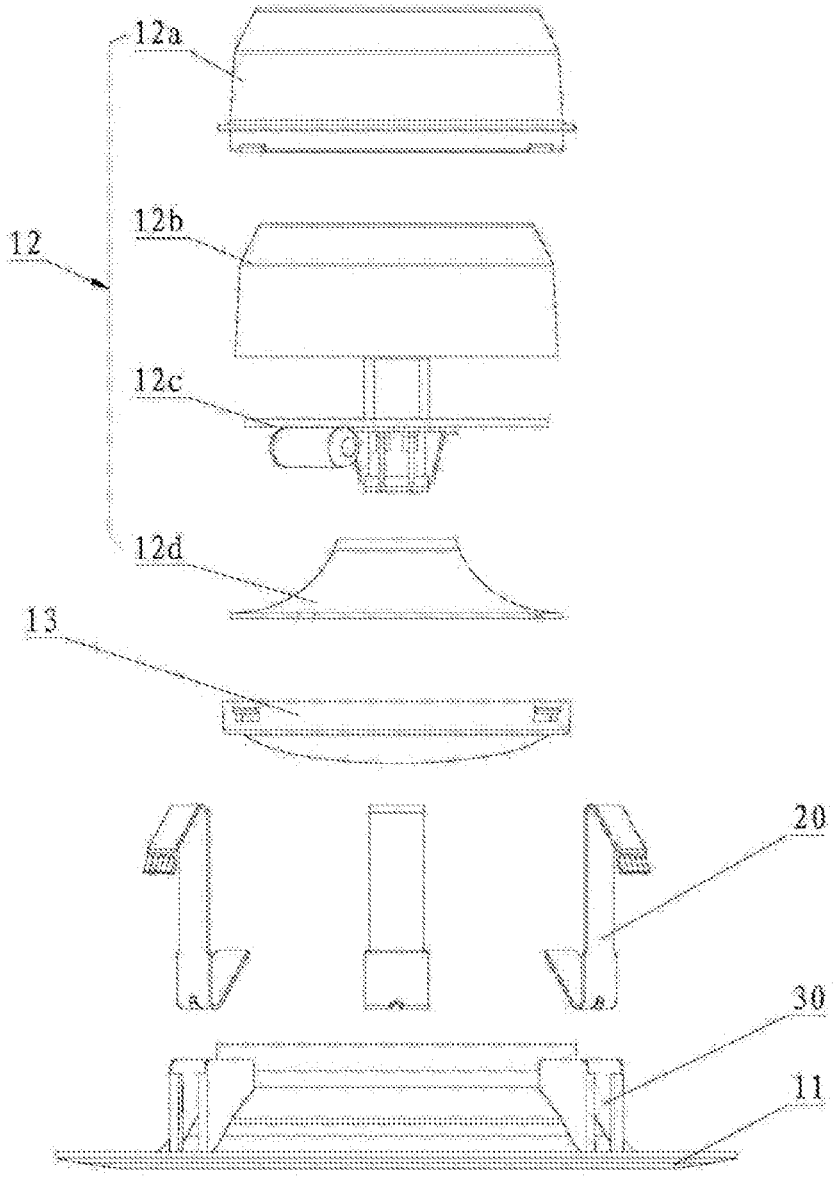
FIG. 6 is an exploded perspective view of the third structure of the downlight apparatus according to the present invention.

Furthermore, please refer to FIG. 4, FIG. 5*a* and FIG. 6. The housing 10 further includes a cover 13. The cover 13 and the main cup 12 form a closed waterproof space. The LED light source is mounted inside the waterproof space. The surface ring 11 is installed on the outer part of the cover 13 and the main cup 12.

As mentioned above, the benefit of the present invention is that water is certainly excluded from the LED light source through the waterproof space formed by the cover and the main cup, the downlight apparatus could be installed with the LED light source facing upward. The installation of the downlight apparatus needn't worry about rain.

Please refer to FIG. 1 to FIG. 6. One of the preferred embodiments of the present invention provides a downlight apparatus 100 including a housing 10, a hook 20, and a hook slot 30.

The housing 10 includes a surface ring 11, an main cup 12, and a cover 13. The main cup 12 is assembled in sequence of a power driving component 12*a*, a heat sink 12*b*, a LED light source component 12*c*, and a reflector 12*d*. The cover 13 is mounted on the reflector 12*d*, and a waterproof space is formed between the cover 13 and the main cup 12. The LED light source of the LED light source component 12*c* is placed inside the waterproof space. The surface ring 11 is installed on the outer part of the cover 13 and the main cup 12.

The hook 20 is a metal leaf spring structure with a Z shape. The hook 20 includes a hook part 21 and a connection part 22. The hook part 21 and the connection part 22 are set on opposite sides of the hook 20. The connection part 22 is formed by bending the end of the hook 20. Because the downlight apparatus 100 is fixed to the mounting structure by the hook 20, to increase the friction of the contact area between the hook part 21 and the mounting structure, the end of the hook part 21 is designed as a lateral wave shape.

There are three hook slots 30. Three hook slots 30 are uniformly distributed around the axis of the downlight apparatus 100 on the surface ring 11. Each hook slot 30 is enclosed by two parallel side walls 32 which stick out from the surface of the surface ring 11. One end of the side wall 32 is fastened on the surface of the surface ring 11, and the other end of the side wall 32 is provided with the stop wall 33. A stop block 31 is set on the surface of surface ring 11, inside the hook slot 30.

The connection part 22 of the hook 20 is elastically fixed to the hook slot 30. The end of the connection part 22 is attached to the stop block 31. The other part of the connection part 22 is attached to the surface of surface ring 11, the inside of side wall 32, and the stop wall 33 respectively, which ensures the stability of the hook 20.

To sum up, the hook of the downlight apparatus of the present invention removes the screw type connection of current technology. Compared with current technology, the structure is simplified, the production process is less complicated, the production cost is low. The installation of the hook slot doesn't need screws anymore, the hook is moved into the hook slot with physical pressure. It not only makes cost savings but also has the benefit of automation, the production efficiency doubles. Moreover, in actual production, the main cup 12 and the cover 13 of the embodiment may be designed to a module, the module is produced and assembled independently. The hook slot 30 and the surface ring 11 are integrally formed into a body by injecting plastic into a molding, then the hook 20 is pushed into the hook slot by automatic assembly machines. The surface ring 11, the hook slot 30, and the hook 20 can be designed to another module produced and assembled independently. At the last step of production, two modules are fixed together by hooks, then the assembly of whole light is done. The design prevents the assembly of two modules from influencing each other, two modules can be produced independently, the limitation from the installation processes disappears. The installation of components is automatic, which is helpful to mass production and increase the competition of product. Meanwhile, different modules may be used to other similar products, the number of molding development is decreased, the cost of molding development is reduced.

Figure 7A:
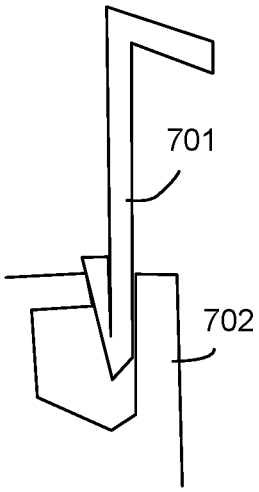
FIG. 7*a* illustrates a hook example entering a hook slot.
Figure 7B:
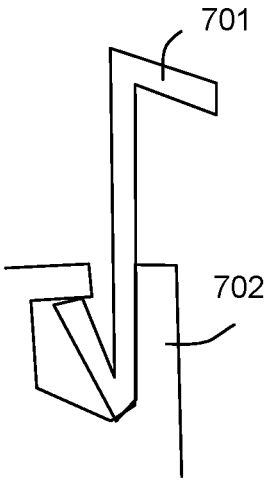
FIG. 7*b* illustrates the hook example inserted in the hook slot.

In FIG. 7*a* and FIG. 7*b*, a first type of hook as mentioned above is illustrated on how the hook is entering and inserted in the hook slot.

In FIG. 7*a* and FIG. 7*b*, the hook 701 is pressed and its bottom hook is bent so as to pass the narrow entrance of the hook slot 702. After the hook 701 passes the narrow entrance, the elastic force of the hook 701 recovers the bottom hook to its original angle. When this occurs, the bottom hook engages the stop block 703 and locked in the hook slot.

Figure 8A:
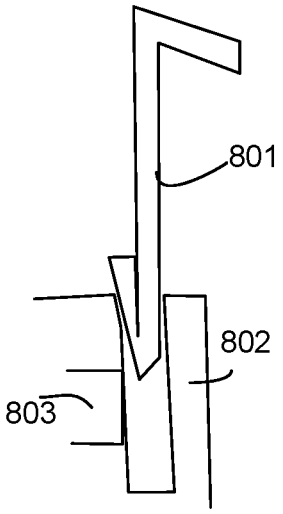
FIG. 8*a* illustrates another hook example entering a hook slot.
Figure 8B:
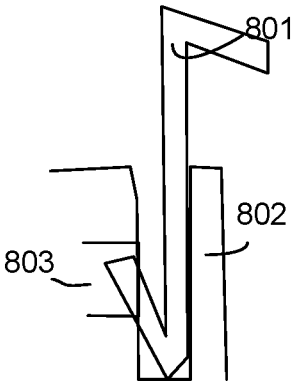
FIG. 8*b* illustrates the hook example inserted in the hook slot.

In FIG. 8*a* and FIG. 8*b*, a second type of hook as mentioned above is illustrated, on how the hook is entering and then inserted in the hook slot.

In FIG. 8*a* and FIG. 8*b*, the hook slot 802 has a slot hole 803. The hook 801 has its bottom hook bent so as to pass the narrow entrance of the hook slot. Then, the bottom hook meets the slot hole 803, extended and thus locked in the slot hole 803.

An advantage of the embodiment includes preventing use of traditional screw fixture structure, which may speed up manufacturing and save manufacturing cost.

The invention has been shown and described above with the preferred embodiments, it should be understood clearly that these descriptions are made only by way of example and are not intended to limit the scope of the invention. Any equivalent exchange, direct application, or indirect application in relative technical field according to the present invention and drawings are included in the patent empathy scope of the invention.

The invention claimed is:

1. A downlight apparatus comprising:

a major housing having a surface ring and a main cup, the main cup containing a LED plate and a driver circuit, the LED plate emitting light through an opening of the surface ring;

a plurality of hook slots located surrounding the main cup; and a plurality of hooks having bottom hooks being inserted and locked in corresponding hook slots respectively and having top hooks to fix the major housing on a ceiling.

2. The downlight apparatus of claim 1, wherein the hook is a piece of metal component, the top hook and the bottom hook are formed by bending the piece of metal component.

3. The downlight apparatus of claim 2, wherein the top hook and the bottom hook are bent with opposite directions.

4. The downlight apparatus of claim 3, wherein the bent angle between the bottom hook and a major part of the hook is less than 50 degrees.

5. The downlight apparatus of claim 2, wherein the top hook and the bottom hook are bent facing to each other.

6. The downlight apparatus of claim 1, wherein the bottom hook is inserted into the hook slot to be locked, when the bottom hook is during insertion, the bottom hook has an elastic shape change to enter the hook slot, and when the bottom hook is inserted, the bottom hook is locked by a stop structure of the hook slot.

7. The downlight apparatus of claim 6, wherein the stop structure comprises a stop block, a top edge of the bottom hook engages with the stop block to be locked in the hook slot.

8. The downlight apparatus of claim 6, wherein the stop structure comprises a slot hole for receiving part of the bottom hook when the bottom hook is inserted in the hook slot.

9. The downlight apparatus of claim 1, wherein the hook slot has a sop wall, when the bottom hook is during insertion, the stop wall has an elastic shape change, and when the bottom hook is inserted, the stop wall recovers from the elastic shape change.

10. The downlight apparatus of claim 1, wherein when the hooks are locked in the hook slots, the hooks are non-detachable from the hook slots with bare hands.

11. The downlight apparatus of claim 1, wherein the hook slots are disposed at external lateral side of the main cup.

12. The downlight apparatus of claim 1, wherein the hook slots are disposed at the surface ring.

13. The downlight apparatus of claim 1, wherein fixing glue is added in the hook slots.

14. The downlight apparatus of claim 1, wherein the main cup is detachable from the surface ring, and the main cup and the surface ring are combined with a clamp structure.

15. The downlight apparatus of claim 1, further comprising a waterproof cover between the main cup and the surface ring.

16. The downlight apparatus of claim 1, wherein the main cup and the surface ring are formed together with one piece plastic material.

17. The downlight apparatus of claim 1, wherein the top hook has curved grooves.

18. The downlight apparatus of claim 1, wherein the top hook is connected to a spring bar, the spring bar is used for installing the downlight apparatus on a ceiling.

19. The downlight apparatus of claim 1, wherein there are two hooks at opposite positions at two sides of the main cup.

20. The downlight apparatus of claim 1, wherein there are three hooks evenly distributed around the main cup.

* * * * *